US011439224B2

(12) United States Patent
Wright

(10) Patent No.: US 11,439,224 B2
(45) Date of Patent: Sep. 13, 2022

(54) PORTABLE OUTDOOR SUPPLY ASSEMBLY

(71) Applicant: Sherry Wright, Las Vegas, NV (US)

(72) Inventor: Sherry Wright, Las Vegas, NV (US)

( * ) Notice: Subject to any disclaimer, the term of this patent is extended or adjusted under 35 U.S.C. 154(b) by 258 days.

(21) Appl. No.: 16/824,247

(22) Filed: Mar. 19, 2020

(65) Prior Publication Data

US 2021/0289926 A1 Sep. 23, 2021

(51) Int. Cl.

| | |
|---|---|
| ***A45C 11/20*** | (2006.01) |
| ***B65D 77/04*** | (2006.01) |
| ***A45C 11/00*** | (2006.01) |
| ***B65D 85/00*** | (2006.01) |
| ***F25D 3/08*** | (2006.01) |
| ***A45F 3/46*** | (2006.01) |
| ***B65D 77/06*** | (2006.01) |
| ***B65D 51/24*** | (2006.01) |

(52) U.S. Cl.

CPC ..... *A45F 3/46* (2013.01); *A45C 11/00* (2013.01); *B65D 51/242* (2013.01); *B65D 77/06* (2013.01); *A45C 11/20* (2013.01); *A45C 2011/007* (2013.01); *B65D 2577/043* (2013.01); *F25D 3/08* (2013.01)

(58) Field of Classification Search

CPC .... A45F 3/46; A45C 5/06; A45C 7/00; A45C 11/00; A45C 11/20; A45C 2011/007; A45C 7/0045; A45C 7/005; A45C 13/02; A45C 2005/037; B65D 51/242; B65D 77/06; B65D 2577/043; B65D 2577/042; B65D 2577/045; B65D 2577/047; B65D 81/3825; F25D 3/08

USPC ..... 206/223, 542; 190/110

See application file for complete search history.

(56) References Cited

U.S. PATENT DOCUMENTS

| | | | | | |
|---|---|---|---|---|---|
| 1,458,679 | A * | 6/1923 | Bishop | A45C 11/20 | 206/217 |
| 1,487,014 | A * | 3/1924 | Davis | A61F 17/00 | 206/499 |
| 2,939,756 | A | 6/1960 | Butcher | | |
| 3,010,551 | A | 11/1961 | Weeks | | |
| 3,861,504 | A * | 1/1975 | McGraw | A45C 13/02 | 190/110 |
| 4,609,084 | A * | 9/1986 | Thomas | A61F 17/00 | 190/110 |
| 4,852,293 | A * | 8/1989 | Levine | A01K 97/06 | 190/110 |
| 4,866,572 | A * | 9/1989 | Blodgett | A47J 47/14 | 62/331 |
| 5,269,599 | A | 12/1993 | Moring | | |
| 5,350,045 | A * | 9/1994 | Robertson | A45C 13/02 | 190/110 |

(Continued)

*Primary Examiner* — Gideon R Weinerth

(57) ABSTRACT

A portable outdoor supply assembly for providing an all-in-one outdoor supply kit includes a cooler body having a cooler front side, a cooler back side, a cooler left side, a cooler right side, a cooler bottom side, and an open cooler top side defining a cooler inside. A cooler lid is coupled to the cooler body. The cooler lid is hingingly coupled to the cooler back side adjacent the cooler top side to cover and alternatively uncover the cooler top side. Each of a plurality of kit containers has a zipper closure to seal and alternatively unseal a kit inside. The plurality of kit containers is dimensioned to fill the cooler inside. The plurality of kit containers includes a plurality of outdoor items.

1 Claim, 4 Drawing Sheets

(56) References Cited

U.S. PATENT DOCUMENTS 5,363,977 A * 11/1994 Hoff ..... F25D 3/08 220/4.27
5,931,304 A * 8/1999 Hammond ..... A61F 17/00 206/570
5,975,334 A * 11/1999 Mayo ..... A45C 11/20 220/592.2
6,153,857 A * 11/2000 Gunnels ..... A47J 37/0713 126/29
6,464,098 B1 * 10/2002 Henson ..... A47B 43/00 220/475
6,792,935 B2 * 9/2004 Williams ..... A47J 37/0763 126/41 R
6,957,738 B2 * 10/2005 Hammond ..... A61F 17/00 206/570
7,178,693 B1 2/2007 Cutrone
7,331,461 B2 * 2/2008 MacKinnon ..... A45C 13/02 206/553
7,617,828 B1 11/2009 Sinha
7,694,823 B2 4/2010 Fontanesi
8,047,375 B1 * 11/2011 Hartsfield ..... A45C 13/02 206/581
8,844,756 B2 * 9/2014 Beyburg ..... A45F 3/46 220/592.2
9,554,631 B1 * 1/2017 Bongiorno ..... A45C 5/03
9,578,938 B1 * 2/2017 Verneuille ..... A45C 7/00
9,791,200 B2 * 10/2017 Grepper ..... B01F 27/808
10,085,900 B2 * 10/2018 Johnson ..... A61B 50/30
10,441,061 B2 * 10/2019 Wang ..... A45C 9/00
10,575,681 B1 * 3/2020 Womack ..... F25D 3/08
D925,299 S * 7/2021 Nichols ..... D3/301
11,116,297 B1 * 9/2021 Latham ..... B65D 81/02
2002/0043259 A1 * 4/2002 Brennan ..... A47J 37/0781 126/41 R
2003/0029770 A1 * 2/2003 MacKinnon ..... A45C 11/00 206/541
2004/0262319 A1 * 12/2004 Fisher ..... F25D 3/08 220/528
2005/0029272 A1 * 2/2005 Padilla ..... B25H 3/02 220/735
2007/0044877 A1 * 3/2007 Davidoff ..... A45C 13/02 190/110
2008/0142558 A1 * 6/2008 Dexter ..... B60R 7/02 190/110
2008/0257775 A1 * 10/2008 Randolph ..... A45C 7/005 206/505
2009/0052809 A1 * 2/2009 Sampson ..... B65D 81/389 220/592.2
2010/0307649 A1 * 12/2010 Santos Dominguez ..... A61B 50/312 190/109
2012/0292327 A1 * 11/2012 Carey ..... A45C 13/02 220/592.2
2014/0299505 A1 * 10/2014 Stahle ..... A45C 11/00 53/473
2015/0190920 A1 * 7/2015 Karlsson ..... B25H 3/021 206/223
2015/0208788 A1 * 7/2015 Dass ..... A45D 44/18 132/308
2015/0223586 A1 * 8/2015 Mather ..... A45F 3/04 206/232
2015/0233630 A1 * 8/2015 Bond ..... F25D 3/08 220/735
2015/0238033 A1 * 8/2015 Zavitsanos ..... A45C 11/20 220/592.2
2016/0000197 A1 * 1/2016 MacLean ..... A45C 11/20 220/592.2
2017/0020249 A1 * 1/2017 Schroeder ..... A45C 13/02
2017/0082342 A1 * 3/2017 Weinberg ..... B65D 25/2805
2018/0335241 A1 * 11/2018 Li ..... B65D 25/06
2019/0144164 A1 * 5/2019 Breyburg ..... B65D 85/70 220/495.01
2020/0054107 A1 * 2/2020 Rosemarie ..... A45C 13/03
2020/0107994 A1 * 4/2020 Bernfeld ..... A45C 3/06
2020/0317392 A1 * 10/2020 Stahl ..... A45C 13/02
2021/0227787 A1 * 7/2021 Friedgood ..... A45C 13/02
2021/0289926 A1 * 9/2021 Wright ..... A45C 11/00
2022/0142319 A1 * 5/2022 Strippoli ..... A45C 13/03

* cited by examiner

PORTABLE OUTDOOR SUPPLY ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to outdoor supply devices and more particularly pertains to a new outdoor supply device for providing an all-in-one outdoor supply kit.

(2) Description of Related Art Including Information Disclosed Under 37 CFR 1.97 and 1.98

The prior art relates to outdoor supply devices and kits. Existing devices often do not include an insulated external storage box that can be used as a cooler upon arrival at a location. Existing devices also typically do not include smaller internal storage boxes which arrange to fill the external storage box interior without an internal dividing structure. Such devices also typically do not include a disposable grill.

BRIEF SUMMARY OF THE INVENTION

An embodiment of the disclosure meets the needs presented above by generally comprising a cooler body having a cooler front side, a cooler back side, a cooler left side, a cooler right side, a cooler bottom side, and an open cooler top side defining a cooler inside. A cooler lid is coupled to the cooler body. The cooler lid is hingingly coupled to the cooler back side adjacent the cooler top side to cover and alternatively uncover the cooler top side. Each of a plurality of kit containers has a zipper closure to seal and alternatively unseal a kit inside. The plurality of kit containers is dimensioned to fill the cooler inside. The plurality of kit containers includes a plurality of outdoor items.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
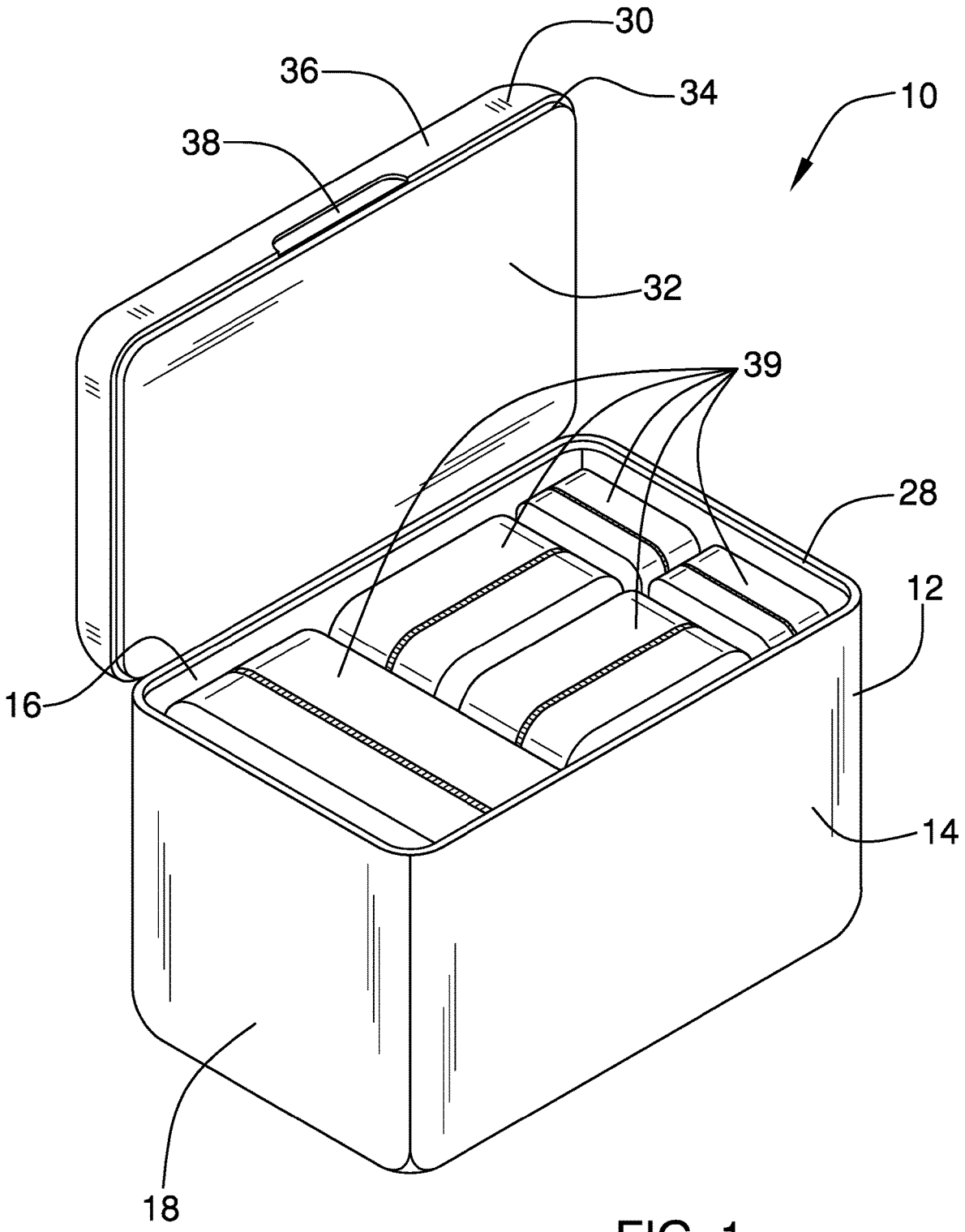
FIG. 1 is an isometric view of a portable outdoor supply assembly according to an embodiment of the disclosure.
Figure 2:
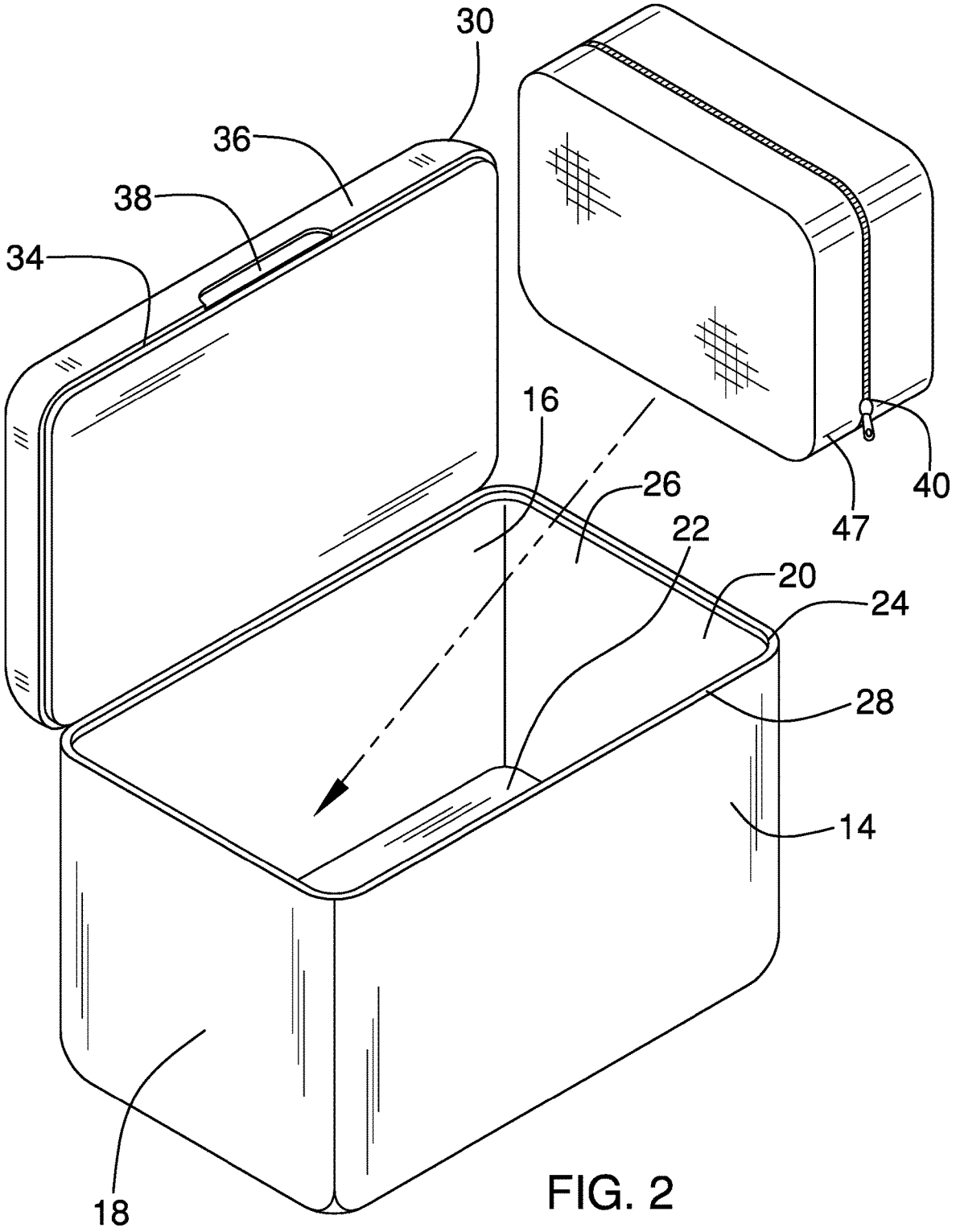
FIG. 2 is an isometric view of an embodiment of the disclosure.
Figure 3:
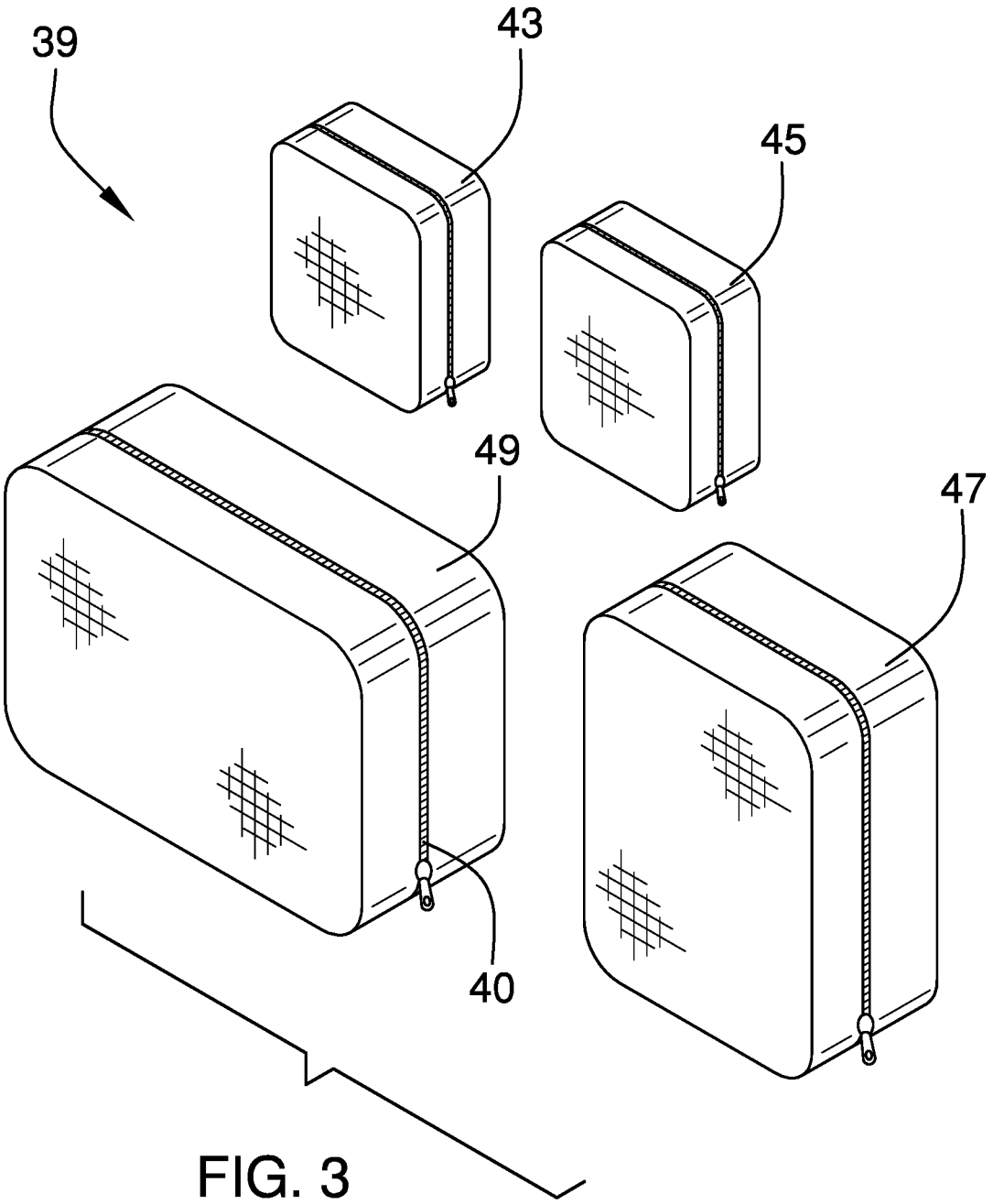
FIG. 3 is an isometric view of an embodiment of the disclosure.
Figure 4:
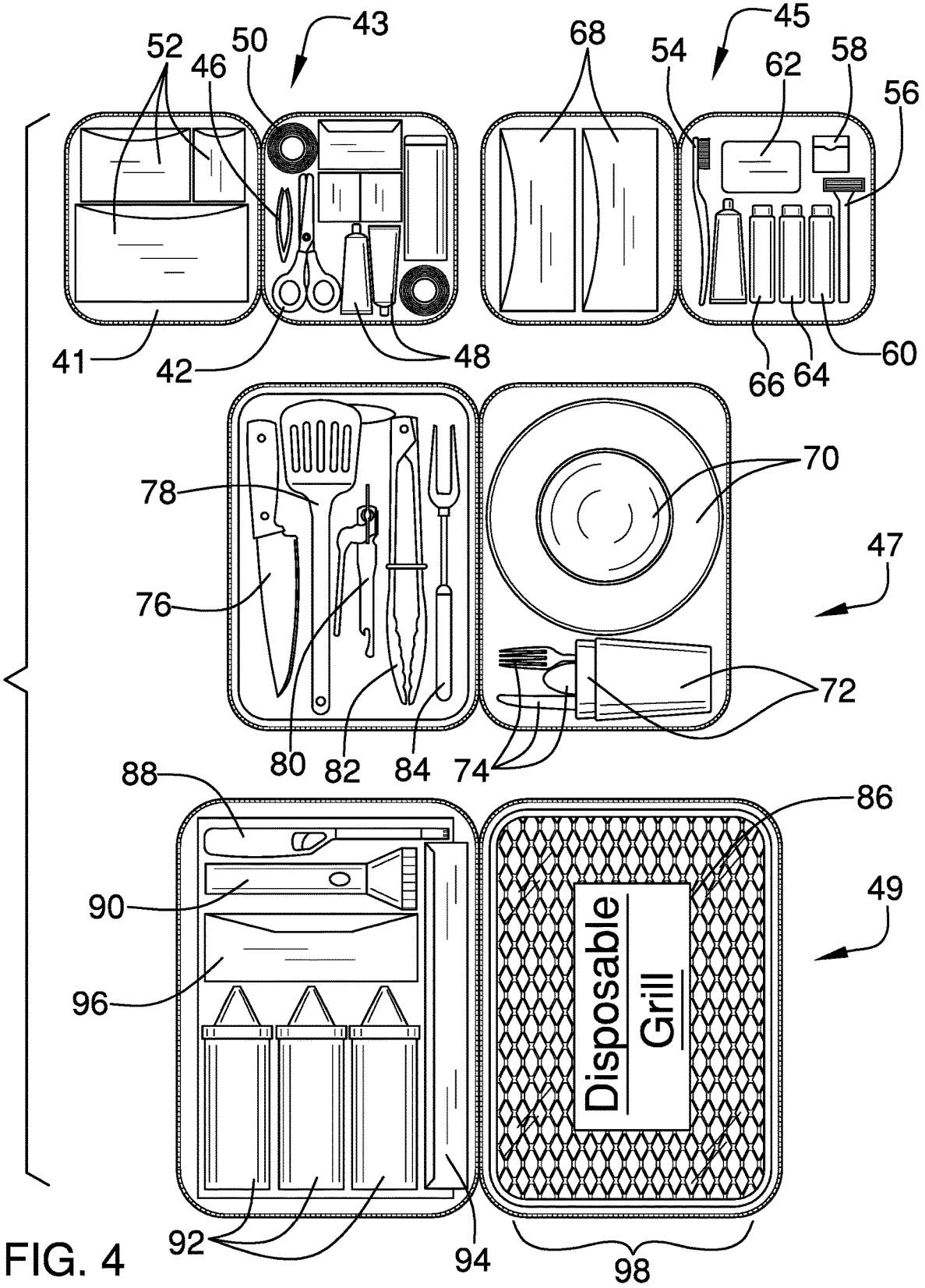
FIG. 4 is a detail view of an embodiment of the disclosure.

With reference now to the drawings, and in particular to FIGS. 1 through 4 thereof, a new outdoor supply device embodying the principles and concepts of an embodiment of the disclosure and generally designated by the reference numeral 10 will be described.

As best illustrated in FIGS. 1 through 4, the portable outdoor supply assembly 10 generally comprises a cooler body 12 having a cooler front side 14, a cooler back side 16, a cooler left side 18, a cooler right side 20, a cooler bottom side 22, and an open cooler top side 24 defining a cooler inside 26. The cooler body 12 may have rounded corners. The cooler top side 24 may have an outer lip 28.

A cooler lid 30 is coupled to the cooler body 12. The cooler lid 30 may be hingingly coupled to the cooler back side 16 adjacent the cooler top side 24 to cover and alternatively uncover the cooler top side 24. An inner face 32 of the cooler lid may have a recessed perimeter 34. The recessed perimeter 34 selectively receives the outer lip 28 of the cooler top side to create a stronger seal. A front face 36 of the cooler lid may have a handle notch 38.

Each of a plurality of kit containers 39 has a zipper closure 40 to seal and alternatively unseal a kit inside 41. The plurality of kit containers 39 is dimensioned to fill the cooler inside 26. The plurality of kit containers 39 may comprise a first aid kit 43, a toiletry kit 45, a cooking kit 47, and a camping kit 49.

The first aid kit 43 may include a pair of scissors 42, a tweezer 46, a plurality of ointments 48, a plurality of tape 50, and a plurality of first aid pouches 52. The first aid pouches 52 may be loaded with additional first aid supplies including, but not limited to, bandages, gauze pads, and the like.

The toiletry kit 45 may include a toothbrush 54, a razor 56, a floss 58, a deodorant 60, a soap 62, a lotion 64, a bug repellent 66, and a plurality of toiletry pouches 68. The plurality of toiletry pouches 68 may be loaded with additional toiletries such as, but not limited to, combs, brushes, nail files, clippers, hair sprays, wipes, and the like.

The cooking kit 47 may include a plurality of bowls 70, a plurality of cups 72, a plurality of utensils 74, a knife 76, a spatula 78, a can opener 80, a pair of tongs 82, and a grill fork 84. The cooking kit 46 may also include additional cooking items such as, but not limited to, a peeling knife, measuring cups, a cutting board, spices, and the like.

The camping kit 49 may include a disposable grill 86, a lighter 88, a flashlight 90, a plurality of condiment containers 92, a foil roll 94, and a camping pouch 96. The camping pouch 96 may be loaded with additional camping supplies such as, but not limited to, matches, trash bags, batteries, and the like. The disposable grill 86 may occupy a right half 98 of the kit inside 41 of the camping kit. The camping kit 49 may be larger than the cooking kit 47 and the cooking kit 47 may be larger than each of the equally sized first aid kit 43 and the toiletry kit 45.

In use, the assembly 10 is easily packed for any outdoor excursion. The plurality of kit containers 39 are then removed upon arrival and the cooler body 12 may be used as a cooler for maintaining food and beverages cool.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A portable outdoor supply assembly comprising:

a cooler body having a cooler front side, a cooler back side, a cooler left side, a cooler right side, a cooler bottom side, and an open cooler top side defining a cooler inside, the cooler body having rounded corners, the cooler top side having an outer lip;

a cooler lid coupled to the cooler body, the cooler lid being hingingly coupled to the cooler back side adjacent the cooler top side to cover and alternatively uncover the cooler top side, an inner face of the cooler lid having a recessed perimeter, the recessed perimeter selectively receiving the outer lip of the cooler top side, a front face of the cooler lid having a handle notch; and a plurality of kit containers, each of the kit containers being distinct and separate from each other kit container, each of the plurality of kit containers having a zipper closure to seal and alternatively unseal a kit inside, the plurality of kit containers being dimensioned to till the cooler inside such that an edge of each kit container is exposed adjacent to the cooler lid wherein each kit container is configured to be accessible and separately removable from the cooler body, the plurality of kit containers comprising:

a first aid kit, the first aid kit including a pair of scissors, a tweezer, a plurality of ointments, a plurality of tape, and a plurality of first aid pouches;

a toiletry kit, the toiletry kit including a toothbrush, a razor, a floss, a deodorant, a soap, a lotion, a bug repellent, and a plurality of toiletry pouches;

a cooking kit, the cooking kit including a plurality of bowls, a plurality of cups, a plurality of utensils, a knife, a spatula, a can opener, a pair of tongs, and a grill fork; and a camping kit, the camping kit including a disposable grill, the disposable grill occupying a right half of the kit inside of the camping kit, a lighter, a flashlight, a plurality of condiment containers, a foil roll, and a camping pouch, the camping kit being larger than the cooking kit, the cooking kit being larger than each of the equally sized first aid kit and the toiletry kit.

* * * * *